United States Patent [19]

Gönner

[11] Patent Number: 4,501,178

[45] Date of Patent: Feb. 26, 1985

[54] DEVICE FOR SEVERING ROUND TIMBER

[75] Inventor: Siegmar Gönner, Oberkirch, Fed. Rep. of Germany

[73] Assignee: Gebrüder Linck Maschinenfabrik und Eisengiesserei "Gatterlinck", Oberkirxh, Fed. Rep. of Germany

[21] Appl. No.: 471,639

[22] Filed: Mar. 3, 1983

[30] Foreign Application Priority Data

Mar. 3, 1982 [DE] Fed. Rep. of Germany ..... 3207547

[51] Int. Cl.[3] ..... B27B 25/04

[52] U.S. Cl. ..... 83/107; 83/113; 83/435; 83/435.2

[58] Field of Search ..... 83/27, 102, 102.1, 105, 83/107, 111, 112, 113, 435.2, 435, 423; 144/242 D, 245 A

[56] References Cited

U.S. PATENT DOCUMENTS 387,604 8/1888 St. Louis ..... 83/435.2 X 2,044,902 6/1936 Ferenci ..... 83/102.1

2,454,316 11/1948 Haecks ..... 83/102

3,500,882 3/1970 Tanguay ..... 83/113 X

*Primary Examiner*—James M. Meister

*Attorney, Agent, or Firm*—Michael J. Striker

[57] ABSTRACT

A device for severing round timber includes a rotatable circular saw and a transversal feeding device feeding round timber pieces towards the saw and for feeding cut sections of the timber from the saw towards the discharge end of the device. The feeding device includes a number of rotary conveying chains arranged in groups in the feeding direction at one side of the saw and at the opposite side of the saw. The conveying chains of two groups extend in the feeding direction such that they include an acute angle with each other and diverge from one another whereby timber sections cut off by the saw tend to move away from each other and, after being cut off, do not contact the saw teeth in the area of the saw blade.

5 Claims, 2 Drawing Figures

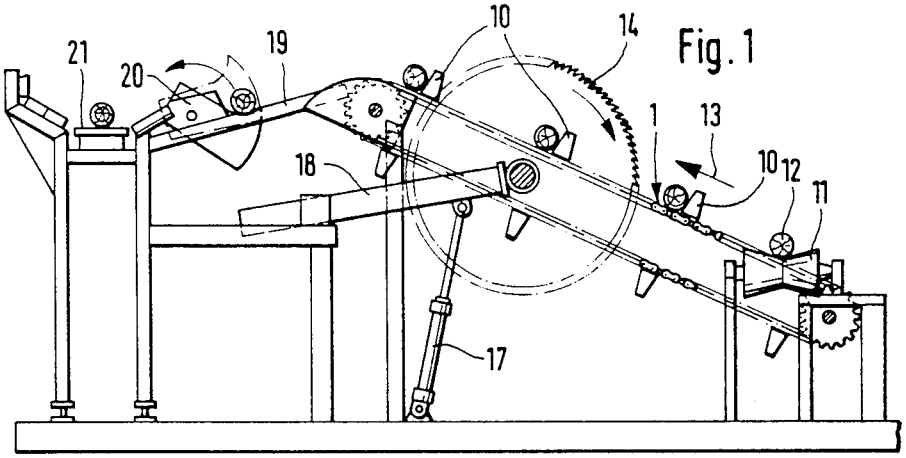
Fig. 1
Fig. 2
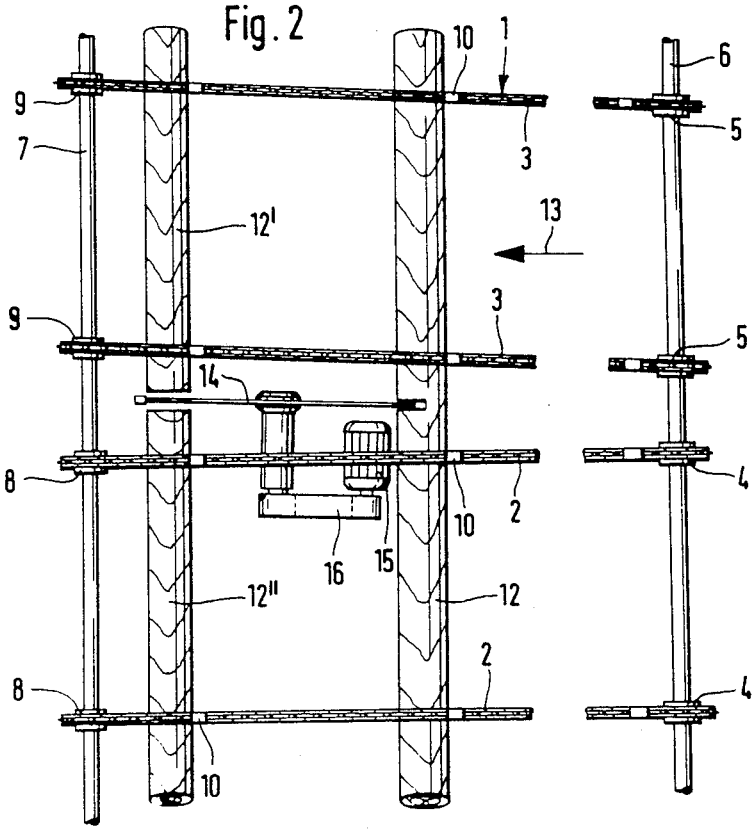

DEVICE FOR SEVERING ROUND TIMBER

BACKGROUND OF THE INVENTION

The present invention pertains to devices for splitting up round timber in general. More particularly, the invention pertains to a device for severing round timber by means of a circular saw blade and of the type having a transversal feeding unit for transporting round timber pieces to the saw.

The devices for severing round timber of the type under discussion normally include a number of conveying chains equipped with carriers transporting round timber pieces from the feeding end of the device toward its discharge end. In the devices of the foregoing type a continuous and uninterrupted advancement of the round timber to the saw has been provided in which the round timber has been separated into sections by the circular saw. The aforementioned carriers usually guide individual round timber pieces towards the rotating circular saw and the direction of rotation of the saw is normally selected such that the round timber is pressed downwardly onto the conveying chains upon the engagement of the timber with the circular saw and is maintained in such a position while the conveying chains move further with respect to the saw and the severing operation is performed.

During the further movement of the conveying chains, after a round timber piece has been cut off into two sections, the surfaces of cut of those sections continue to move along the blade of the circular saw. The direction of the circular movement of the saw is, at the position at which the round timber leaves the circle area of the saw, changed from downward to the upward one. When the surfaces of cut of the cut timber sections in this area come into contact with the teeth of the saw blade, the cut section can slip off the chain which can lead to any kind of emergency, or damage to the machine or to the round timber being processed. Holding arrangements, which have been employed to hold the round timber in the region of the exit of the saw circle, unfavorably affect the transport of the round timber for further processing, particularly the holding arrangements which must be adjusted for various thicknesses of the round timber. Further difficulties have been encountered when relatively high and impact-like loads occured in the severing process, for example when, after having been initially in contact with the saw in the aforementioned exit area thereof, the round timber had to be lifted and then twisted and clamped.

SUMMARY OF THE INVENTION

It is an object of the invention to provide a round timber severing device which avoids the disadvantages of conventional devices of the type under consideration.

It is a further object of the invention to provide an improved device for splitting up round timber, in which by very simple means contact of the surfaces of cut of round timber sections with the circular saw in the region of the exit from the circle of the saw blade is totally prevented.

These and other objects of the invention are attained by a device for severing round timber, comprising a rotary circular saw having a sectional plane, and transversal feeding means for feeding round timber being processed towards said saw and further from said saw, said feeding means having a feed-in end and a discharge end and including a plurality of rotatable conveying chains arranged side by side, said conveying chains being arranged in at least one group positioned at one side of the sectional plane of the saw and in at least another group positioned at an opposite side of the sectional plane of the saw, the conveying chains of said one group and said another group extending in a feeding direction from said feed-in end to said discharge end at an acute angle with respect to the sectional plane of the circular saw so that the conveying chains of said one group diverge from the conveying chains of said another group Due to the invention the cut round sections lying on the conveying chains positioned at two opposite sides from the saw blade tend to move away from each other during the transport movement thereof. When the cut round timber sections leave the region of the circle of the saw the surfaces of cut of the timber sections separated by the saw are positioned at a distance from the saw blade so that undesirable new contact of the cut sections with the teeth of the saw blade is avoided.

Conventional holding arrangements or similar devices are no longer required.

The proposed device is simple in construction and is inexpensive.

According to a further feature of the invention the feeding means may further include a first shaft disposed at said discharge end and a second shaft parallel to said first shaft and disposed at said feed-in end, a plurality of chain wheels arranged in pairs for each respective conveying chain of the one group and another group on the first shaft and the second shaft such that each conveying chain in the respective group runs over the respective pair of the chain wheels.

One of said pairs of the chain wheels may be positioned at one side of the sectional plane of the saw and the other of said pairs may be positioned at an opposite side of said sectional plane, the respective chain wheels of said one pair and said other pair which are both positioned on said first shaft, being spaced from each other by a distance greater than a distance between the respective chain wheels of said one pair and said other pair, which are both positioned on said second shaft.

It is to be noted that in the transversal feeding device of the invention open-link chains can be utilized without, however affecting their function with so many lateral plays due to the sloped or inclined positioning of the conveying chains according to the invention. Therefore it is possible to arrange at the feed-in end and at the discharge end of the device, respectively, only one individual shaft with chain wheels thereon. By changing the distance between the chain wheels mouted at both sides of the saw any desired inclination of the conveying chains may be obtained.

The conveying chains of said one group may extend normal to the first and second shaft and the conveying chains of the another group may extend obliquely relative to said first and second shaft, said sectional plane of the saw extending approximately through an angle bisector defined between the one group of the chains and another group.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 1 is a schematic side view of the transversal conveying device for feeding round timber to be cut with a circular saw, according to the invention; and FIG. 2 is a simplified schematic top plan view of the device of FIG. 1, with some components omitted.

DETAILED DESCRIPTION OF THE PREFERRED EMBODIMENTS

Referring now to the drawings, a transversal conveying device for feeding round timber to be cut into sections is designated in toto as 1. The conveying device comprises two groups of endless rotary conveyor chains 2 and 3 which feed round timber denoted as 12 from a feed-in end towards a circular saw 14 and further to a discharge end of the device, for further processing.

For the sake of simplicity only two conveying chains 2 and 3 in each group, respectively, are illustrated in FIG. 2.

Conveying chains 2 and 3 run at the feed-in end, which is at the right-hand side of the drawing in the plane of FIG. 2, by means by chain wheels 4 and 5, respectively, which wheels are supported on a common shaft 6. A second shaft 7 arranged in parallel with shaft 6 is provided at the discharge end of the conveying device. Shaft 7 carries chain wheels 8 and 9 over which chains 2 and 3, respectively run at the discharge end. It is understood that round timber piece 12 is fed from the feed-in end towards the discharge end in the direction of arrow 13. Both shafts 6 and 7 are driven by any suitable conventional drive means. Respective conveying chains 3,3 in one group of chains extend parallel to each other. Similarly, conveying chains 2,2 in another group of the chains also extend parallel to each other.

Each conveying chain 2,3 is provided with a plurality of carriers or holder 10 for holding round timber pieces in their travel path along the chains. Carriers 10 at each chain are uniformly spaced from each other. Carriers 10 receive round timber pieces 12 from a roller conveyor rail 11 mounted at the feed-in end of the device and transport them towards the circular saw 14 in the direction of arrow 13. Circular saw 14 is arranged between two groups of conveying chains 2 and 3.

As shown in FIG. 2, the circular saw is driven by a drive motor 15 through a drive belt 16 connected to the shaft of the saw blade. The movement of the circular saw 14 in the vertical plane to cut off the round timber therebelow is provided by means of a pivotable arm 18 which is raised and descended by a pressure medium-operated piston-cylinder unit 17 in the conventional mode.

The circular saw blade divides round timber 12 into sections 12' and 12'' as shown in FIG. 2. These sections at the discharge end of the transversal conveying device drop onto a sloped surface 19 from which the cut sections of the round timber are transported to a longitudinal conveyor 21 of any suitable kind known in the art. This transport is achieved by means of a handling-over device 20 provided with a swinging unit transferring cut sections of the round timber 12 to the conveyor 20. It should be realized that the handling-over device may be of any conventional type and is not described herein in detail because it is not a part of the present invention.

Referring back to FIG. 2 it is seen that the conveying chains 2 positioned at one side of the sectional plane of the saw blade 14 are parallel to one another in the respective one group of the chains. Conveying chains 2 in such a group are disposed perpendicular to the shafts 6 and 7. The conveying chains 3 of another group of the chains, however, extend at an obtuse angle with respect to the axes of shafts 6 and 7 thereby diverging from the sectional plane of circular saw 14. In other words, the conveying chains 3 run obliquely on the respective chain wheels 5 and 9.

The sectional plane of the saw blade 14 extends approximately through an angle bisector defined between two groups of the conveying chains 2 and 3. Due to the fact that an acute angle is included between a plane formed by the conveying chains 2 with respect to the sectional plane of the saw blade 14, on the one hand, and a plane formed by the conveying chains 3 with respect to the sectional plane of the saw blade 14, on the other hand, it is achieved that round timber sections 12' and 12'' of the round timber fed by both diverging groups of conveying chains 2 and 3 in the feeding direction 13 are moved somewhat away from each other and their surfaces of cut are separated from the saw 14 due to the diverging arrangement of the conveying chains. When section 12' and 12'' of the round timber being processed are discharged from the circle of the circular blade of saw 14 the cut surfaces of those sections are disposed at a distance from the saw 14 so that they have no contact with the teeth of the saw blade at this position.

The inclined position of the groups of the chains 2 and 3 toward each other is provided herein in a very simple manner such that the distance between chain wheel 9 and chain wheel 8 facing each other on shaft 7, e.g. at the discharge end of the device, is greater than the distance between two chain wheels 5 and 6 facing each other on shaft 6, e.g. at the feed-in end of the device, in each respective group of the conveying chains.

It will be understood that each of the elements described above, or two or more together, may also find a useful application in other types of device for severing round timber differing from the types described above.

While the invention has been illustrated and described as embodied in a device for splitting-up round timber, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for severing round timber, comprising a rotary circular saw having a sectional plane and teeth and cutting round timber into sections, and tranversal feeding means for feeding round timber being processed towards said saw and further from said saw, said feeding means having a feed-in end and a discharge end and including a plurality of rotatable conveying chains arranged side by side, said conveying chains being arranged in at least one group positioned at one side of the sectional plane of the saw and in at least another group positioned at an opposite side of the sectional plane of the saw, the conveying chains of said one group and the conveying chains of said another group being arranged relative to each other so that they extend in a feeding direction from said feed-in end to said discharge end at an acute angle with respect to the sectional plane of the circular saw so that the conveying chains of said one group diverge from the conveying chains of said another group and the sections completely separated from each other by said circular saw and further fed by said one and another group, respectively, are moved away from each other, whereby a contact of cut surfaces of said sections with the saw teeth in a circle area of the saw, after the cutting has been completed, is prevented.

2. The device as defined in claim 1, wherein said feeding means further include a first shaft disposed at said discharge end and a second shaft parallel to said first shaft and disposed at said feed-in end, a plurality of chain wheels arranged in pairs on said first shaft and said second shaft for each respective conveying chain in said one group and said another group such that each conveying chain in the respective group runs over the respective pair of the chain wheels.

3. The device as defined in claim 2, wherein one of said pairs of the chain wheels is positioned at one side of the sectional plane of the saw and the other of said pairs is positioned at an opposite side of said sectional plane, the respective chain wheels of said one pair and said other pair, which are both positioned on said first shaft, being spaced from each other by a distance greater than a distance between the respective chain wheels of said one pair and said other pair which are both positioned on said second shaft.

4. The device as defined in claim 3, wherein the conveying chains of said one group extend normal to said first and second shafts and the conveying chains of said another group extend obliquely relative to said first and second shaft, said sectional plane of the saw extending approximately through an angle bisector defined between said one group of the chains and said another group.

5. The device as defined in claim 1, wherein each conveyor chain is provided with a plurality of carriers spaced apart from each other along the chain and operative for transporting round timber pieces being processed from said feed-in end to said discharge end.

* * * * *

UNITED STATES PATENT AND TRADEMARK OFFICE

CERTIFICATE OF CORRECTION

PATENT NO. : 4,501,178

DATED : February 26, 1985

INVENTOR(S) : Siegmar Gonner

It is certified that error appears in the above-identified patent and that said Letters Patent is hereby corrected as shown below:

The title page should be deleted to appear as per attached title page.

Figures 1-4 should be deleted to be replaced with figures 1 and 2 as shown on the attached sheets.

This certificate to apply to the Grant Only.

Signed and Sealed this

Twenty-eighth Day of April, 1987

*Attest:*

DONALD J. QUIGG

*Attesting Officer*

*Commissioner of Patents and Trademarks*

United States Patent [19]

Gönner

[11] Patent Number: 4,501,178

[45] Date of Patent: Feb. 26, 1985

[54] DEVICE FOR SEVERING ROUND TIMBER

[75] Inventor: Siegmar Gönner, Oberkirch, Fed. Rep. of Germany

[73] Assignee: Gebrüder Linck Maschinenfabrik und Eisengiesserei "Gatterlinck", Oberkirxh, Fed. Rep. of Germany

[21] Appl. No.: 471,639

[22] Filed: Mar. 3, 1983

[30] Foreign Application Priority Data

Mar. 3, 1982 [DE] Fed. Rep. of Germany ..... 3207547

[51] Int. Cl.[3] ..... B27B 25/04

[52] U.S. Cl. ..... 83/107; 83/113; 83/435; 83/435.2

[58] Field of Search ..... 83/27, 102, 102.1, 105, 83/107, 111, 112, 113, 435.2, 435, 423; 144/242 D, 245 A

[56] References Cited

U.S. PATENT DOCUMENTS 387,604 8/1888 St. Louis ..... 83/435.2 X 2,044,902 6/1936 Ferenci ..... 83/102.1

2,454,316 11/1948 Haecks ..... 83/102

3,500,882 3/1970 Tanguay ..... 83/113 X

*Primary Examiner*—James M. Meister

*Attorney, Agent, or Firm*—Michael J. Striker

[57] ABSTRACT

A device for severing round timber includes a rotatable circular saw and a transversal feeding device feeding round timber pieces towards the saw and for feeding cut sections of the timber from the saw towards the discharge end of the device. The feeding device includes a number of rotary conveying chains arranged in groups in the feeding direction at one side of the saw and at the opposite side of the saw. The conveying chains of two groups extend in the feeding direction such that they include an acute angle with each other and diverge from one another whereby timber sections cut off by the saw tend to move away from each other and, after being cut off, do not contact the saw teeth in the area of the saw blade.

5 Claims, 2 Drawing Figures

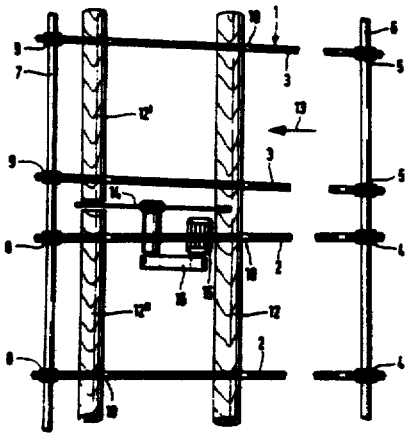

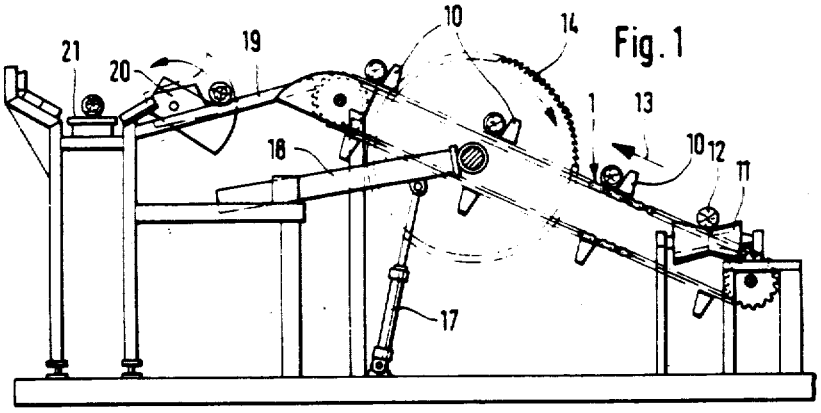
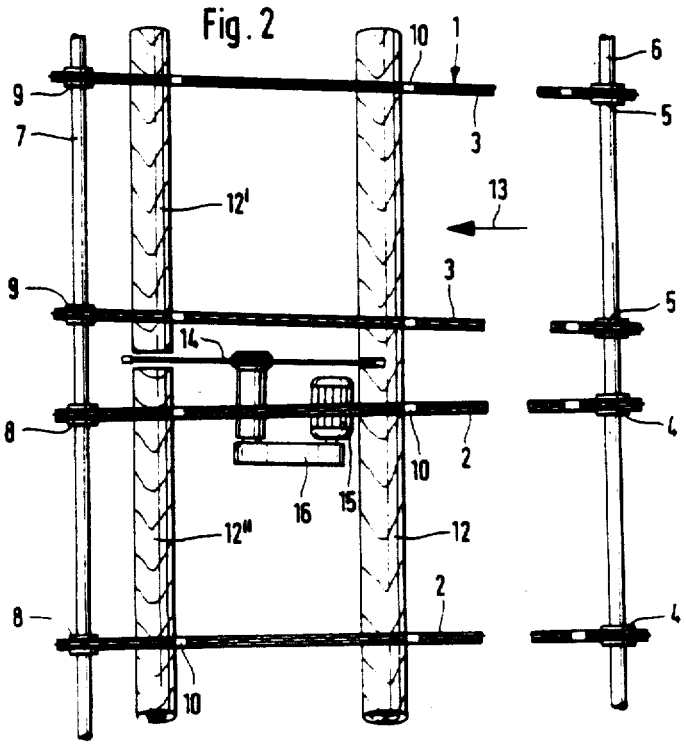

U.S. Patent Feb. 26, 1985 4,501,178